US007854835B2

(12) United States Patent
Hoover et al.

(10) Patent No.: US 7,854,835 B2
(45) Date of Patent: Dec. 21, 2010

(54) DESULFURIZATION PROCESS

(75) Inventors: Victor G. Hoover, Pearl River, LA (US); Max W. Thompson, Sugar Land, TX (US); Darrin D. Barnes, Katy, TX (US); Joe D. Cox, Fritch, TX (US); Philip L. Collins, Ponca City, OK (US); Christopher J. Lafrancois, Bartlesville, OK (US); Ricky E. Snelling, Tulsa, OK (US); Jean B. Thesee, Sugar Land, OK (US); Robert Zapata, Stillwater, OK (US)

(73) Assignee: China Petroleum & Chemical Corporation, Beijing (CN)

( * ) Notice: Subject to any disclaimer, the term of this patent is extended or adjusted under 35 U.S.C. 154(b) by 1115 days.

(21) Appl. No.: 11/537,715

(22) Filed: Oct. 2, 2006

(65) Prior Publication Data

US 2009/0283448 A1 Nov. 19, 2009

Related U.S. Application Data

(62) Division of application No. 10/798,821, filed on Mar. 11, 2004, now Pat. No. 7,182,918.

(51) Int. Cl.
*C10G 25/00* (2006.01)
*C10G 25/12* (2006.01)

(52) U.S. Cl. ..... 208/250; 208/173; 208/176

(58) Field of Classification Search ..... 208/208 R, 208/243, 244, 247, 299, 305, 173, 176, 250
See application file for complete search history.

(56) References Cited

U.S. PATENT DOCUMENTS 5,270,018 A * 12/1993 Scheuerman ..... 422/213
2002/0147110 A1* 10/2002 Dodwell et al. ..... 502/407
2003/0192811 A1* 10/2003 Thompson et al. ..... 208/208 R

* cited by examiner

*Primary Examiner*—Walter D Griffin
*Assistant Examiner*—Renee Robinson
(74) *Attorney, Agent, or Firm*—Hovey Williams LLP

(57) ABSTRACT

A hydrocarbon desulfurization system that circulates fluidizable solid particles through a fluidized bed reactor, a fluidized bed regenerator, and a fluidized bed reducer to thereby provide for substantially continuous desulfurization of a hydrocarbon-containing fluid stream and substantially continuous regeneration of the solid particles. A novel transport system is employed for transporting the solid particles between the reactor, the regenerator, and the reducer. The transport system uses close-coupled vessels and gravity flow between various vessels to minimize equipment cost and particle attrition.

47 Claims, 5 Drawing Sheets

DESULFURIZATION PROCESS

This Application is a Divisional of application Ser. No. 10/798,821, filed Mar. 11, 2004, now U.S. Pat. No. 7,182,918 now allowed.

BACKGROUND OF THE INVENTION

This invention relates to a method and apparatus for removing sulfur from hydrocarbon-containing fluid streams using fluidizable and circulatable solid particles. In another aspect, the invention concerns in a hydrocarbon desulfurization unit having an improved design that reduces capital expense and operating expense while providing for enhanced sulfur removal and particle circulation.

Hydrocarbon-containing fluids such as gasoline and diesel fuels typically contain a quantity of sulfur. High levels of sulfurs in such automotive fuels are undesirable because oxides of sulfur present in automotive exhaust may irreversibly poison noble metal catalysts employed in automobile catalytic converters. Emissions from such poisoned catalytic converters may contain high levels of non-combusted hydrocarbons, oxides of nitrogen, and/or carbon monoxide, which, when catalyzed by sunlight, form ground level ozone, more commonly referred to as smog.

Much of the sulfur present in the final blend of most gasolines originates from a gasoline blending component commonly known as "cracked-gasoline." Thus, reduction of sulfur levels in cracked-gasoline will inherently serve to reduce sulfur levels in most gasolines, such as, automobile gasolines, racing gasolines, aviation gasolines, boat gasolines, and the like. Many conventional processes exist for removing sulfur from cracked-gasoline. However, most conventional sulfur removal processes, such as hydrodesulfurization, tend to saturate olefins and aromatics in the cracked-gasoline and thereby reduce its octane number (both research and motor octane number). Thus, there is a need for a process wherein desulfurization of cracked-gasoline is achieved while the octane number is maintained.

In addition to the need for removing sulfur from cracked-gasoline, there is also a need to reduce the sulfur content in diesel fuel. In removing sulfur from diesel fuel by conventional hydrodesulfurization, the cetane is improved but there is a large cost in hydrogen consumption. Such hydrogen is consumed by both hydrodesulfurization and aromatic hydrogenation reactions. Thus, there is a need for a process wherein desulfurization of diesel fuel is achieved without significant consumption of hydrogen so as to provide a more economical desulfurization process.

Recently, improved desulfurization techniques employing regenerable solid sorbents have been developed to meet the above-mentioned needs. Such regenerable sorbents are typically formed with a metal oxide component (e.g., ZnO) and a promoter metal component (e.g., Ni). When contacted with a sulfur-containing hydrocarbon fluid (e.g., cracked-gasoline or diesel fuel), the promoter metal and metal oxide components of the regenerable sorbent cooperate to remove sulfur from the hydrocarbon and store the removed sulfur on/in the sorbent via the conversion of the metal oxide component (e.g., ZnO) to a metal sulfide (e.g., ZnS). The resulting "sulfur-loaded" sorbent can then be regenerated by contacting the sulfur-loaded sorbent with an oxygen-containing regeneration stream. During regeneration, the metal sulfide (e.g, ZnS) in the sulfur-loaded sorbent is returned to its original metal oxide form (e.g., ZnO) via reaction with the oxygen-containing regeneration stream. Further, during regeneration the promoter metal is oxidized to form an oxidized promoter metal component (e.g., NiO). After regeneration, the oxidized sorbent can then be reduced by contacting the oxidized sorbent with a hydrogen-containing reducing stream. During reduction, the oxidized promoter metal component is reduced to thereby return the sorbent to an optimum sulfur-removing state having a metal oxide component (e.g., ZnO) and a reduced-valence promoter component (e.g., Ni). After reduction, the reduced sorbent can once again be contacted with the sulfur-containing hydrocarbon fluid to remove sulfur therefrom.

Traditionally, solid sorbent compositions used in hydrocarbon desulfurization processes have been agglomerates utilized in fixed bed applications. However, because fluidized bed reactors provide a number of advantages over fixed bed reactors, it is desirable to process hydrocarbon-containing fluids in fluidized bed reactors. One significant advantage of using fluidized bed reactors in desulfurization systems employing regenerable solid sorbents is the ability to continuously regenerate the solid sorbent particles after they have become "loaded" with sulfur. Such regeneration can be performed by continuously circulating the solid sorbent particles from a reactor vessel, to a regenerator vessel, to a reducer vessel, and then back to the reactor. Thus, employing a sorbent composition that is both fluidizable and circulatable allows for substantially continuous removal of sulfur from a hydrocarbon-containing fluid stream and substantially continuous sorbent regeneration.

When designing a desulfurization unit employing a fluidized bed reactor, a fluidized bed regenerator, and a fluidized bed reducer which provide for continuous sulfur removal via fluidizable and circulatable solid sorbent particles, many design parameters must be considered. One of the main considerations in designing any desulfurization unit is the initial capital cost of the unit. The number of vessels, valves, conduits, and other equipment in the unit contributes significantly to the capital cost of a desulfurization unit. Further, the elevation of the individual vessels in a desulfurization unit can contribute significantly to the capital cost of the desulfurization unit because the support structure for supporting large vessels high above the ground can add considerably to the construction and maintenance costs of the unit.

Another important consideration in designing a desulfurization unit is operating cost. Complex particle transport systems (e.g., pneumatic conveyors) can increase operating costs due to frequent maintenance and/or breakdowns. In desulfurization units employing fluidizable and circulatable solid particles to remove sulfur from a hydrocarbon-containing fluid, particle attrition can cause also increased operating cost. Generally, attrition of solid particles is increased when solid particles are transported at high velocity. Thus, desulfurization units that employ dilute phase transport of the solid particles through and between vessels can cause significant attrition of the particles. When the solid particles employed in the desulfurization unit experience high levels of attrition, the solid particles must be replaced at frequent intervals, thereby increasing operating cost and downtime of the unit.

SUMMARY OF THE INVENTION

Accordingly, it is an object of the present invention to provide a novel hydrocarbon desulfurization system which provides for continuous sulfur removal via fluidizable, circulatable, and regenerable solid particles.

A further object of the invention is to provide a hydrocarbon desulfurization system which minimizes capital cost by employing a minimum amount of vessels, conduits, valves, and other equipment.

A still further object of the invention is to provide a desulfurization system which minimizes capital cost by maintaining vessels at a minimum elevation above ground level.

Another object of the invention is to provide a hydrocarbon desulfurization system which minimizes attrition of the solid particles circulated therein by minimizing the velocity of the solid particles transported throughout the system.

It should be noted that the above-listed objects need not all be accomplished by the invention claimed herein and other objects and advantages of this invention will be apparent from the following description of the preferred embodiment, appended claims, and drawing figures.

Accordingly, in one embodiment of the present invention, there is provided a desulfurization unit employing fluidizable and circulatable solid particles to remove sulfur from a hydrocarbon-containing feed. The desulfurization unit comprises a fluidized bed reactor, a fluidized bed regenerator, and a fluidized bed reducer close-coupled to the reactor.

In another embodiment of the present invention, there is provided a desulfurization unit employing fluidizable and circulatable solid particles to remove sulfur from a hydrocarbon-containing feed. The desulfurization unit comprises a reactor having a reactor solids inlet and a reactor solids outlet, a regenerator having a regenerator solids inlet and a regenerator solids outlet, a reducer having a reducer solids inlet and reducer solids outlet, a first transport assembly for transporting the solid particles from the reactor solids outlet to the regenerator solids inlet, a second transport assembly for dense phase transporting the solid particles from the regenerator solids outlet to the reducer solids inlet, and a third transport assembly for transporting the solid particles from the reducer solids outlet to the reactor solids inlet.

In still another embodiment of the present invention, there is provided a desulfurization unit employing fluidizable and circulatable solid particles to remove sulfur from a hydrocarbon-containing feed. The desulfurization unit comprises a reactor, a reactor stripper, a reactor lockhopper, a regenerator feed surge vessel, and a regenerator. The reactor is operable to contact the hydrocarbon-containing feed with the solid particles. The reactor stripper is fluidly coupled to the reactor and operable to receive the solid particles from the reactor. The reactor lockhopper is fluidly coupled to the reactor and vertically positioned lower than the reactor stripper so as to allow for gravity flow of the solid particles from the reactor stripper to the reactor lockhopper. The regenerator feed surge vessel is fluidly coupled to the reactor lockhopper and vertically positioned lower than the reactor lockhopper so as to allow for gravity flow of the solid particles from the reactor lockhopper to the regenerator feed surge vessel. The regenerator is fluidly coupled to the regenerator feed surge vessel and is operable to receive the solid particles from the regenerator feed surge vessel.

In a still further embodiment of the present invention, there is provided a method of desulfurizing a hydrocarbon-containing fluid. The method comprises the steps of: (a) contacting the hydrocarbon-containing fluid with solid particles in a desulfurization zone under deulfurization conditions sufficient to remove sulfur from the hydrocarbon-containing fluid and provide sulfur-loaded solid particles; (b) contacting the sulfur-loaded solid particles with an oxygen-containing regeneration stream in a regeneration zone under regeneration conditions sufficient to remove sulfur from the sulfur-loaded solid particles, thereby providing oxidized solid particles; (c) contacting the oxidized solid particles with a hydrogen-containing reducing stream in a reducing zone under reducing conditions sufficient to reduce the oxidized solid particles, thereby providing reduced solid particles; and (d) dense phase transporting the reduced solid particles from the reducing zone to the desulfurization zone.

In yet another embodiment of the present invention, there is provided a method desulfurizing a hydrocarbon-containing fluid. The method comprises the steps of: (a) contacting the hydrocarbon-containing fluid with solid particles in a fluidized bed reactor under desulfurization conditions sufficient to remove sulfur from the hydrocarbon-containing fluid and provide sulfur-loaded solid particles; (b) contacting the sulfur-loaded solid particles with an oxygen-containing regeneration stream in a fluidized bed regenerator under conditions sufficient to remove sulfur from the sulfur-loaded solid particles, thereby providing oxidized solid particles; (c) dense phase transporting the oxidized solid particles from the fluidized bed regenerator to a fluidized bed reducer; and (d) contacting the oxidized solid particles with a hydrogen-containing reducing stream in the fluidized bed reducer under reducing conditions sufficient to reduce the oxidized solid particles, thereby providing reduced solid particles.

In still another embodiment of the present invention, there is provided a method of desulfurizing a hydrocarbon-containing fluid. The method comprises the steps of: (a) contacting the hydrocarbon-containing fluid with solid particles in a desulfurization zone under desulfurization conditions sufficient to remove sulfur from the hydrocarbon-containing fluid and provide sulfur-loaded solid particles; (b) contacting the sulfur-loaded solid particles with a stripping gas in a stripping zone under stripping conditions sufficient to remove the hydrocarbon-containing fluid from around the sulfur-loaded solid particles; (c) batchwise transporting the sulfur-loaded solid particles from the stripping zone to a reactor lockhopper; (d) batchwise transporting the sulfur-loaded solid particles from the reactor lockhopper to a regenerator surge feed vessel; (e) substantially continuously transporting the sulfur-loaded solid particles from the regenerator feed surge vessel to a regeneration zone; and (f) contacting the sulfur-loaded solid particles with an oxygen-containing regeneration stream in the regeneration zone under regeneration conditions sufficient to remove sulfur from the sulfur-loaded solid particles, thereby providing oxidized solid particles.

DETAILED DESCRIPTION OF THE PREFERRED EMBODIMENTS

Figure 1:
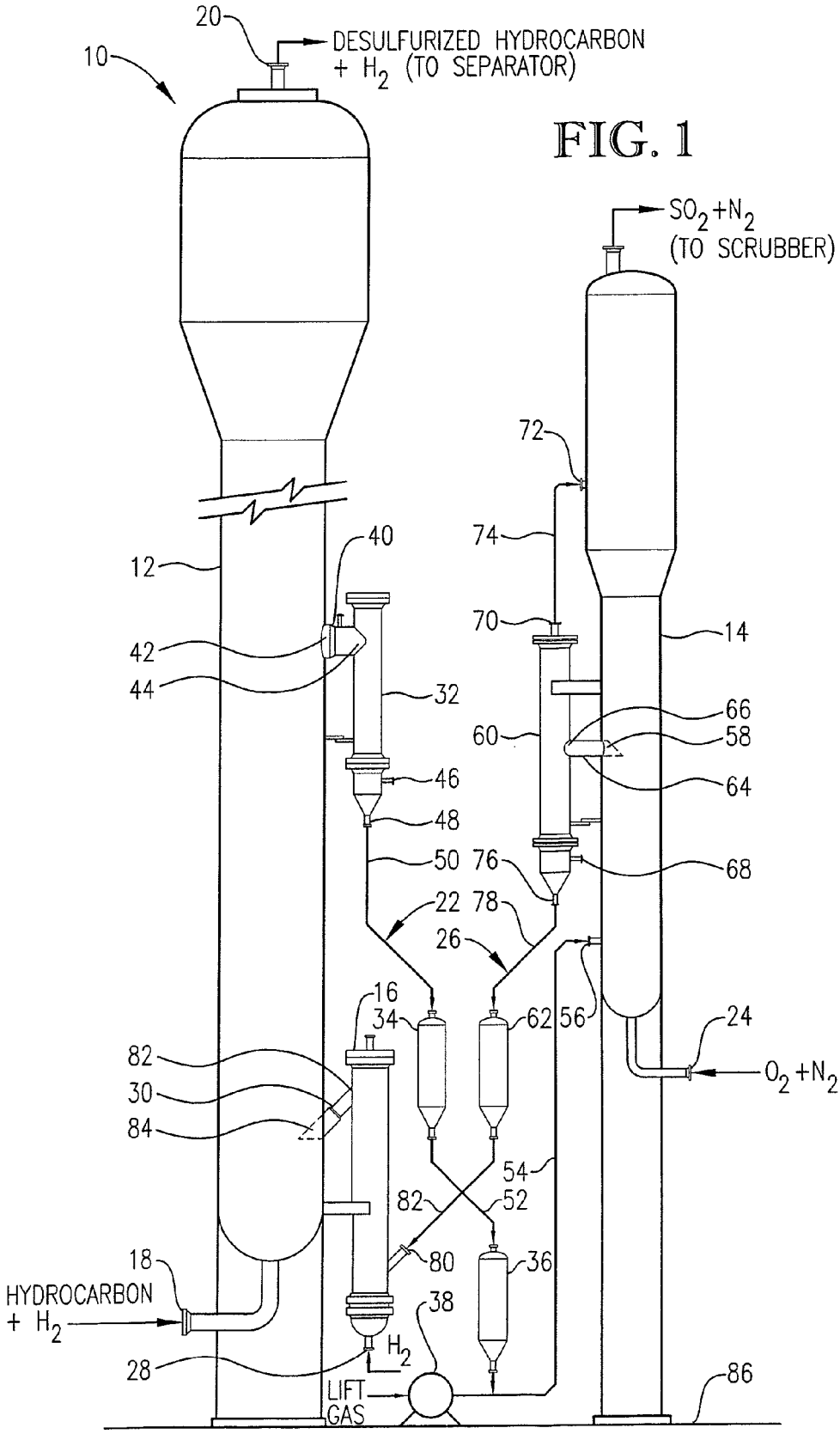
FIG. 1 is a schematic diagram of a desulfurization unit constructed in accordance with the principals of the present invention, particularly illustrating the relative elevations of various vessels employed in the desulfurization unit and the manner in which these vessels are connected so as to allow for circulation of solid particles through the unit.

Referring initially to FIG. 1, a desulfurization unit 10 is illustrated as generally comprising a fluidized bed reactor 12, a fluidized bed regenerator 14, and a fluidized bed reducer 16. Solid sorbent particles are circulated in desulfurization unit 10 to provide for continuous sulfur removal from a sulfur-containing hydrocarbon, such as cracked-gasoline or diesel fuel, entering desulfurization unit 10 via a feed inlet 18. The solid sorbent particles employed in desulfurization unit 10 can be any sufficiently fluidizable, circulatable, and regenerable zinc oxide-based composition having sufficient desulfurization activity and sufficient attrition resistance. A description of such a sorbent composition is provided in U.S. patent application Ser. No. 09/580,611, U.S. patent application Ser. No. 10/738,141 and U.S. patent application Ser. No. 10/072,209, the entirety of all disclosures of which are incorporated herein by reference.

A hydrocarbon-containing fluid stream enters reactor 12 via feed inlet 18 and is passed upwardly through a bed of reduced solid sorbent particles in the reaction zone of reactor 12. The reduced solid sorbent particles contacted with the hydrocarbon-containing stream in reactor 12 preferably initially (i.e., immediately prior to contacting with the hydrocarbon-containing fluid stream) comprise zinc oxide and a reduced-valence promoter metal component. Though not wishing to be bound by theory, it is believed that the reduced-valence promoter metal component of the reduced solid sorbent particles facilitates the removal of sulfur from the hydrocarbon-containing stream, while the zinc oxide component operates as a sulfur storage mechanism via its conversion to zinc sulfide.

The reduced-valence promoter metal component of the reduced solid sorbent particles preferably comprises a promoter metal selected from a group consisting of nickel, cobalt, iron, manganese, tungsten, silver, gold, copper, platinum, zinc, tin, ruthenium, molybdenum, antimony, vanadium, iridium, chromium, palladium, and mixtures of two or more thereof. More preferably, the reduced-valence promoter metal component comprises nickel as the promoter metal. As used herein, the term "reduced-valence" when describing the promoter metal component, shall denote a promoter metal component having a valence which is less than the valence of the promoter metal component in its common oxidized state. More specifically, the reduced solid sorbent particles employed in reactor 12 should include a promoter metal component having a valence which is less than the valence of the promoter metal component of the regenerated (i.e., oxidized) solid sorbent particles exiting regenerator 14. Most preferably, substantially all of the promoter metal component of the reduced solid sorbent particles has a valence of zero (0).

In a preferred embodiment of the present invention the reduced-valence promoter metal component comprises, consists of, or consists essentially of, a substitutional solid metal solution characterized by the formula: $M_AZn_B$, wherein M is the promoter metal, Zn in zinc, and A and B are each numerical values in a range of from 0.01 to 0.99. In the above formula for the substitutional solid metal solution, it is preferred for A to be in a range of from about 0.70 to about 0.97, and most preferably in a range of from about 0.85 to about 0.95. It is further preferred for B to be in a range of from about 0.03 to about 0.30, and most preferably in a range of from about 0.05 to 0.15, for best sulfur removal. Preferably, B is equal to (1-A).

Substitutional solid solutions have unique physical and chemical properties that are important to the chemistry of the sorbent composition employed in desulfurization unit 10. Substitutional solid solutions are a subset of alloys that are formed by the direct substitution of the solute metal for the solvent metal atoms in the crystal structure. For example, it is believed that the substitutional solid metal solution ($M_AZn_B$) found in the reduced solid sorbent particles employed in desulfurization unit 10 is formed by the solute zinc metal atoms substituting for the solvent promoter metal atoms. There are three basic criteria that favor the formation of substitutional solid solutions: (1) the atomic radii of the two or more elements are within 15 percent of each other; (2) the crystal structures of the two or more pure phases are the same or have a common face; and (3) the electronegativities of the two or more components are similar. The promoter metal (as the elemental metal or metal oxide) and zinc oxide employed in the solid sorbent particles described herein preferably meet at least two of the three criteria set forth above. For example, when the promoter metal is nickel, the first and third criteria, are met, but the second is not. The nickel and zinc metal atomic radii are within 10 percent of each other and the electronegativities are similar. However, nickel oxide (NiO) preferentially forms a cubic crystal structure, while zinc oxide (ZnO) prefers a hexagonal crystal structure. It is believed that a nickel zinc solid solution retains the cubic structure of the nickel oxide. Forcing the zinc oxide to reside in the cubic structure increases the energy of the phase, which limits the amount of zinc that can be dissolved in the nickel oxide structure. This stoichiometry control manifests itself microscopically in about a 92:8 nickel zinc solid solution ($Ni_{0.92}Zn_{0.08}$) that is formed during reduction and microscopically in the repeated regenerability of the solid sorbent particles.

In addition to zinc oxide and the reduced-valence promoter metal component, the reduced solid sorbent particles employed in reactor 12 may further comprise a porosity enhancer and a promoter metal-zinc aluminate substitutional solid solution. The promoter metal-zinc aluminate substitutional solid solution can be characterized by the formula: $M_ZZn_{(1-Z)}Al_2O_4$), wherein M is the promoter metal and the subscript Z is a numerical value in the range of from 0.01 to 0.99. The porosity enhancer, when employed, can be any compound which ultimately increases the macroporosity of the solid sorbent particles. Preferably, the porosity enhancer is perlite. The term "perlite" as used herein is the petrographic term for a siliceous volcanic rock which naturally occurs in certain regions throughout the world. The distinguishing feature, which sets it apart from other volcanic minerals, is its ability to expand four to twenty times its original volume when heated to certain temperatures. When heated above 1600° F., crushed perlite expands due to the presence of combined water with crude perlite rock. The combined water vaporizes during the heating process and creates countless tiny bubbles in the heat softened glassy particles. It is these diminutive glass sealed bubbles which account for its light weight. Expanded perlite can be manufactured to weigh as little as 2.5 lbs per cubic foot. Typical chemical analysis properties, based on mass, of expanded perlite are approximately: silicon dioxide 73%, aluminum oxide 17%, potassium oxide 5%, sodium oxide 3%, calcium oxide 1%, plus trace elements. Typical physical properties of expanded perlite are approximately: softening point 1600-2000° F., fusion point 2300° F.-2450° F., pH 6.6-6.8, and specific gravity 2.2-2.4. The term "expanded perlite" as used herein refers to the spherical form of perlite which has been expanded by heating the perlite siliceous volcanic rock to a temperature above 1600° F. The term "particulate expanded perlite" or "milled perlite" as used herein denotes that form of expanded perlite which has been subjected to crushing so as to form a particulate mass wherein the particle size of such mass is comprised of at least 97% of particles having a size of less than 2 microns. The term "milled expanded perlite" is intended to mean the product resulting from subjecting expanded perlite particles to milling or crushing.

The reduced solid sorbent particles initially contacted with the hydrocarbon-containing fluid stream in reactor 12 preferably comprise zinc oxide, a reduced-valence promoter metal component ($M_AZn_B$), a porosity enhancer (PE), and a promoter metal-zinc aluminate ($M_ZZn_{(1-Z)}Al_2O_4$) in the ranges provided below in Table 1.

TABLE 1

Components of the Reduced Solid Sorbent Particles

| | Range | | | |
|---|---|---|---|---|
| | ZnO (wt %) | $M_AZn_B$ (wt %) | PE (wt %) | $M_ZZn_{(1-Z)}Al_2O_4$ (wt %) |
| Preferred | 5-80 | 5-80 | 2-50 | 1-50 |
| More Preferred | 20-60 | 20-60 | 5-30 | 5-30 |
| Most Preferred | 30-50 | 30-40 | 10-20 | 10-20 |

The physical properties of the solid sorbent particles which significantly affect the suitability of the particles for use in desulfurization unit 10 include, for example, particle shape, particle size, particle density, and particle resistance to attrition. Solid sorbent particles employed in desulfurization unit 10 preferably comprise microspherical particles having a mean particle size in the range of from about 20 to about 150 microns, more preferably in the range of from about 50 to about 100 microns, and most preferably in the range of from 60 to 80 microns for best desulfurization activity and desulfurization reactor operations. The density of the solid sorbent particles is preferably in a range of from about 0.5 to about 1.5 grams per cubic centimeter (g/cc), more preferably in a range of from about 0.8 to about 0.3 g/cc, and most preferably in a range of from 0.9 to 1.2 g/cc for best desulfurization operations. The particle size and density of the solid sorbent particles preferably qualify the solid sorbent particles as a Group A solid under the Geldart group classification system described in *Powder Technol.*, 7, 285-292 (1973).

The solid sorbent particles preferably have high resistance to attrition. As used herein, the term "attrition resistance" denotes a measure of a particle's resistance to size reduction under controlled conditions of turbulent motion. The attrition resistance of a particle can be quantified using the jet cup attrition test, similar to the Davidson Index. The Jet Cup Attrition Index (JCAI) represents the weight percent of the over 44 micrometer particle size fraction which is reduced to particle sizes of less than 37 micrometers under test conditions and involves screening a 5 gram sample of sorbent to remove particles in the 0 to 44 micrometer size range. The particles above 44 micrometers are then subjected to a tangential jet of air at a rate of 21 liters per minute introduced through a 0.0625 inch orifice fixed at the bottom of a specially designed jet cup (1" I.D.×2" height) for a period of 1 hour. The Jet Cup Attrition Index (JCAI) is calculated as follows:

The correction factor (presently 0.3) is determined using a known calibration standard to adjust for the differences in jet cup dimensions and wear. The solid sorbent particles employed in the present invention preferably have a Jet Cup Attrition Index (JCAI) value of less than about 30, more preferably less than about 20, and most preferably less than 10 for best desulfurization operations.

The hydrocarbon-containing fluid stream contacted with the reduced solid sorbent particles in reactor 12 preferably comprises a sulfur-containing hydrocarbon and hydrogen. The molar ratio of the hydrogen to the sulfur-containing hydrocarbon charged to reactor 12 via inlet 18 is preferably in a range of from about 0.1:1 to about 3:1, more preferably in a range of from about 0.2:1 to about 1:1, and most preferably in a range of from 0.4:1 to 0.8:1 for best desulfurization operations. Preferably, the sulfur-containing hydrocarbon is a fluid which is normally in a liquid state at standard temperature and pressure, but which exists in a gaseous state when combined with hydrogen, as described above, and exposed to the desulfurization conditions in reactor 12. The sulfur-containing hydrocarbon preferably can be used as a fuel or a precursor to fuel. Examples of suitable sulfur-containing hydrocarbons include, but are not limited to, cracked-gasoline, diesel fuels, jet fuels, straight-run naphtha, straight-run distillates, coker gas oil, coker naphtha, alkylates, and straight-run gas oil. Most preferably, the sulfur-containing hydrocarbon comprises a hydrocarbon fluid selected from the group consisting of gasoline, cracked-gasoline, diesel fuel, and mixtures thereof.

As used herein, the term "gasoline" denotes a mixture of hydrocarbons boiling in a range of from about 100° F. to about 400° F., or any fraction thereof. Examples of suitable gasolines include, but are not limited to, hydrocarbon streams in refineries such as naphtha, straight-run naphtha, coker naphtha, catalytic gasoline, visbreaker naphtha, alkylates, isomerate, reformate, and the like, and mixtures thereof.

As used herein, the term "cracked-gasoline" denotes a mixture of hydrocarbons boiling in a range of from about 100° F. to about 400° F., or any fraction thereof, that are products of either thermal or catalytic processes that crack larger hydrocarbon molecules into smaller molecules. Examples of suitable thermal processes include, but are not limited to, coking, thermal cracking, visbreaking, and the like, and combinations thereof. Examples of suitable catalytic cracking processes include, but are not limited to, fluid catalytic cracking, heavy oil cracking, and the like, and combinations thereof. Thus, examples of suitable cracked-gasolines include, but are not limited to, coker gasoline, thermally cracked gasoline, visbreaker gasoline, fluid catalytically cracked gasoline, heavy oil cracked-gasoline and the like, and combinations thereof. In some instances, the cracked-gasoline may be fractionated and/or hydrotreated prior to desulfurization when used as the sulfur-containing fluid in the process in the present invention.

As used herein, the term "diesel fuel" denotes a mixture of hydrocarbons boiling in a range of from about 300° F. to about 750° F., or any fraction thereof. Examples of suitable diesel fuels include, but are not limited to, light cycle oil, kerosene, jet fuel, straight-run diesel, hydrotreated diesel, and the like, and combinations thereof.

The sulfur-containing hydrocarbon described herein as suitable feed in the inventive desulfurization process comprises a quantity of olefins, aromatics, and sulfur, as well as paraffins and naphthenes. The amount of olefins in gaseous cracked-gasoline is generally in a range of from about 10 to about 35 weight percent olefins based on the total weight of the gaseous cracked-gasoline. For diesel fuel there is essentially no olefin content. The amount of aromatics in gaseous cracked-gasoline is generally in a range of from about 20 to about 40 weight percent aromatics based on the total weight of the gaseous cracked-gasoline. The amount of aromatics in gaseous diesel fuel is generally in a range of from about 10 to about 90 weight percent aromatics based on the total weight of the gaseous diesel fuel. The amount of atomic sulfur in the sulfur-containing hydrocarbon fluid, preferably cracked-gasoline or diesel fuel, suitable for use in the inventive desulfurization process is generally greater than about 50 parts per million by weight (ppmw) of the sulfur-containing hydrocarbon fluid, more preferably in a range of from about 100 ppmw atomic sulfur to about 10,000 ppmw atomic sulfur, and most preferably from 150 ppmw atomic sulfur to 5,000 ppmw atomic sulfur. It is preferred for at least about 50 weight percent of the atomic sulfur present in the sulfur-containing hydrocarbon fluid employed in the present invention to be in the form of organosulfur compounds. More preferably, at least about 75 weight percent of the atomic sulfur present in the sulfur-containing hydrocarbon fluid is in the form of organosulfur compounds, and most preferably at least 90 weight percent of the atomic sulfur is in the form of organosulfur compounds. As used herein, "sulfur" used in conjunction with "ppmw sulfur" or the term "atomic sulfur", denotes the amount of atomic sulfur (about 32 atomic mass units) in the sulfur-containing hydrocarbon, not the atomic mass, or weight, of a sulfur compound, such as an organosulfur compound.

As used herein, the term "sulfur" denotes sulfur in any form normally present in a sulfur-containing hydrocarbon such as cracked-gasoline or diesel fuel. Examples of such sulfur which can be removed from a sulfur-containing hydrocarbon fluid through the practice of the present invention include, but are not limited to, hydrogen sulfide, carbonyl sulfide (COS), carbon disulfide ($CS_2$), mercaptans (RSH), organic sulfides (R—S—R), organic disulfides (R—S—S—R), thiophene, substituted thiophenes, organic trisulfides, organic tetrasulfides, benzothiophene, alkyl thiophenes, alkyl benzothiophenes, alkyl dibenzothiophenes, and the like, and combinations thereof, as well as heavier molecular weights of the same which are normally present in sulfur-containing hydrocarbons of the types contemplated for use in the desulfurization process of the present invention, wherein each R can by an alkyl, cycloalkyl, or aryl group containing 1 to 10 carbon atoms.

As used herein, the term "fluid" denotes gas, liquid, vapor, and combinations thereof.

As used herein, the term "gaseous" denotes the state in which the sulfur-containing hydrocarbon fluid, such as cracked-gasoline or diesel fuel, is primarily in a gas or vapor phase.

As used herein, the term "finely divided" denotes particles having a mean particle size less than 500 microns.

Referring again to FIG. 1, in fluidized bed reactor 12 the finely divided reduced solid sorbent particles are contacted with the upwardly flowing gaseous hydrocarbon-containing fluid stream under a set of desulfurization conditions sufficient to produce a desulfurized hydrocarbon and sulfur-loaded solid sorbent particles. The flow of the hydrocarbon-containing fluid stream is sufficient to fluidize the bed of solid sorbent particles located in the desulfurization zone of reactor 12. The desulfurization conditions in reactor 12 include temperature, pressure, weight hourly space velocity (WHSV), and superficial velocity. The preferred ranges for such desulfurization conditions are provided below in Table 2.

TABLE 2

Desulfurization Conditions

| | Range | | | |
|---|---|---|---|---|
| | Temp (° F.) | Press. (psig) | WHSV ($hr^{-1}$) | Superficial Vel. (ft/s) |
| Preferred | 250-1200 | 50-750 | 0.1-10 | 0.25-10 |
| More Preferred | 500-1000 | 100-600 | 0.2-8 | 0.5-4 |
| Most Preferred | 700-850 | 150-500 | 0.5-5 | 1.0-1.5 |

When the reduced solid sorbent particles are contacted with the hydrocarbon-containing fluid stream in reactor 12 under desulfurization conditions, sulfur compounds, particularly organosulfur compounds, present in the hydrocarbon-containing fluid stream are removed from such fluid stream. At least a portion of the sulfur removed from the hydrocarbon-containing fluid stream is employed to convert at least a portion of the zinc oxide of the reduced solid sorbent particles into zinc sulfide.

In contrast to many conventional sulfur removal processes, such as, for example, hydrodesulfurization, it is preferred that substantially none of the sulfur in the sulfur-containing hydrocarbon fluid is converted to, and remains as, hydrogen sulfide during desulfurization in reactor 12. Rather, it is preferred that the fluid effluent from a product outlet 20 of reactor 12 (generally comprising the desulfurized hydrocarbon-containing fluid and hydrogen) comprises less than the amount of hydrogen sulfide, if any, in the fluid feed charged to reactor 12 (generally comprising the sulfur-containing hydrocarbon-containing fluid and hydrogen). The fluid effluent from reactor 12 preferably contains less than about 50 weight percent of the amount of sulfur in the fluid feed charged to reactor 12, more preferably less than about 20 weight percent of the amount of sulfur in the fluid feed, and most preferably less than 5 weight percent of the amount of sulfur in the fluid feed. It is preferred for the total sulfur content of the fluid effluent from reactor 12 to be less than about 50 parts per million by weight (ppmw) of the total fluid effluent, more preferably less than about 30 ppmw, still more preferably less than about 15 ppmw, and most preferably less than 10 ppmw.

Referring again to FIG. 1, during desulfurization in reactor 12, at least a portion of the sulfur-loaded sorbent particles are withdrawn from reactor 12 and transported to regenerator 14 via a first transport assembly 22. In regenerator 14, the sulfur-loaded solid sorbent particles are contacted with an oxidizing, preferably an oxygen-containing, regeneration stream which enters regenerator 14 via a regeneration stream inlet 24. The oxygen-containing regeneration stream preferably comprises at least 1 mole percent oxygen with the remainder being a gaseous diluent. More preferably, the oxygen-containing regeneration stream comprises in the range of from about 1 to about 50 mole percent oxygen and in the range of from about 50 to about 95 mole percent nitrogen, still more preferable in the range of from about 2 to about 20 mole percent oxygen and in the range of from about 70 to about 90 mole percent nitrogen, and most preferably in the range of from 3 to 10 mole percent oxygen and in the range of from 75 to 85 mole percent nitrogen.

The regeneration conditions in regenerator 14 are sufficient to convert at least a portion of the zinc sulfide of the sulfur-loaded solid sorbent particles into zinc oxide via contacting with the oxygen-containing regeneration stream. The preferred ranges for such regeneration conditions are provided below in Table 3.

TABLE 3

Regeneration Conditions

| | Range | | |
|---|---|---|---|
| | Temp (° F.) | Press. (psig) | Superficial Vel. (ft/s) |
| Preferred | 500-1500 | 10-250 | 0.5-10 |
| More Preferred | 700-1200 | 20-150 | 0.75-5 |
| Most Preferred | 900-1100 | 30-75 | 1.5-3.0 |

When the sulfur-loaded solid sorbent particles are contacted with the oxygen-containing regeneration stream under the regeneration conditions described above, at least a portion of the promoter metal component is oxidized to form an oxidized promoter metal component. Preferably, in regenerator 14 the substitutional solid solution ($M_AZn_B$) and/or sulfided substitutional solid solution ($M_AZn_BS$) of the sulfur-loaded sorbent is converted to a substitutional solid metal oxide solution characterized by the formula: $M_XZn_YO$, wherein M is the promoter metal, Zn is zinc, and X and Y are each numerical values in a range of from 0.01 to about 0.99. In the above formula, it is preferred for X to be in a range of from about 0.5 to about 0.9 and most preferably from 0.6 to 0.8. It is further preferred for Y to be in a range of from about 0.1 to about 0.5, and most preferably from 0.2 to 0.4. Preferably, Y is equal to (1−X).

The regenerated solid sorbent particles exiting regenerator 14 preferably comprise zinc oxide, the oxidized promoter metal component ($M_XZn_YO$), the porosity enhancer (PE), and the promoter metal-zinc aluminate ($M_ZZn_{(1-Z)}Al_2O_4$) in the ranges provided below in Table 4.

TABLE 4

Components of the Regenerated Solid Sorbent Particles

| | Range | | | |
|---|---|---|---|---|
| | ZnO (wt %) | $M_XZn_YO$ (wt %) | PE (wt %) | $M_ZZn_{(1-Z)}Al_2O_4$ (wt %) |
| Preferred | 5-80 | 5-70 | 2-50 | 1-50 |
| More Preferred | 20-60 | 15-60 | 5-30 | 5-30 |
| Most Preferred | 30-50 | 20-40 | 10-20 | 10-20 |

During regeneration in regenerator 14, at least a portion of the regenerated (i.e., oxidized) solid sorbent particles are withdrawn from the regenerator 14 and transported to reducer 16 via a second transport assembly 26. In reducer 16, the regenerated solid sorbent particles are contacted with a reducing, preferably a hydrogen-containing reducing, stream entering reducer 16 via a reducing stream inlet 28. The hydrogen-containing reducing stream preferably comprises at least 50 mole percent hydrogen with the remainder being cracked hydrocarbon products such as, for example, methane, ethane, and propane. More preferably, the hydrogen-containing reducing stream comprises at least about 70 mole percent hydrogen, and most preferably at least 80 mole percent hydrogen. The reducing conditions in reducer 16 are sufficient to reduce the valence of the oxidized promoter metal component of the regenerated solid sorbent particles. The preferred ranges for such reducing conditions are provided below in Table 5.

TABLE 5

Reducing Conditions

| | Range | | |
|---|---|---|---|
| | Temp (° F.) | Press. (psig) | Superficial Vel. (ft/s) |
| Preferred | 250-1250 | 50-750 | 0.1-10 |
| More Preferred | 600-1000 | 100-600 | 0.2-3 |
| Most Preferred | 750-850 | 150-500 | 0.3-1.0 |

When the regenerated solid sorbent particles are contacted with the hydrogen-containing reducing stream in reducer 16 under the reducing conditions described above, at least a portion of the oxidized promoter metal component is reduced to form the reduced-valence promoter metal component. Preferably, at least a substantial portion of the substitutional solid metal oxide solution ($M_XZn_YO$) is converted to the reduced-valence promoter metal component ($M_AZn_B$).

After the solid sorbent particles have been reduced in reducer 16, they can be transported back to reactor 12, via a third transport assembly 30, for recontacting with the hydrocarbon-containing fluid stream in reactor 12.

Referring again to FIG. 1, as mentioned above, sorbent particles are transported from reactor 12 to regenerator 14 via first transport assembly 22. First transport assembly 22 generally comprises a reactor stripper 32, a reactor lockhopper 34, a regenerator feed surge vessel 36, and a pneumatic lift 38. Reactor stripper 32 is close-coupled to reactor 12 via a reactor outlet close-coupling assembly 40, which extends from a solids outlet 42 of reactor 12 to solids inlet 44 of reactor stripper 32. As used herein, the term "close-coupled" shall denote a manner of fluidly coupling two vessels to one another wherein an open passageway is created from a solids outlet of one vessel to a solids inlet of another vessel, thereby providing for lateral dense phase transport of solids from the solids outlet to the solids inlet. As used herein, the term "dense phase transport" shall denote the transport of solids in the presence of a fluid wherein the average velocity of the fluid in the direction of transport of the solids is less than the saltation velocity. As known in the art of pneumatic particle transfer, "saltation velocity" is the minimum velocity of a fluid required to maintain full suspension of solids being transported by that fluid.

In reactor stripper 32, the downwardly gravitating solid particles are contacted with an upwardly flowing stripping gas that enters reactor stripper 32 via a stripping gas inlet 46. The contacting of the sorbent particles with the stripping gas in reactor stripper 32 strips excess hydrocarbon from around the sorbent particles. During normal operation of desulfurization unit 10, it is preferred for the sorbent particles to be substantially continuously transported from reactor 12 to reactor stripper 32 via close-coupling assembly 40. As used herein, the term "substantially continuously transport" shall denote a manner of continuously transporting solids, or suspended solids, during an uninterrupted transport period of at least about 10 hours.

After stripping of the sorbent particles in reactor stripper 32, the sorbent particles are batchwise transported from a stripper solids outlet 48 of reactor stripper 32 to an inlet of reactor lockhopper 34 via conduit 50. As used herein, the term "batchwise transport" shall denote a manner of intermittently transporting discrete batches of solids, or suspended solids, at intervals interrupted by a period were no transporting occurs, wherein the time between transporting of sequential batches is less than about 10 hours. Thus, reactor stripper 32 continuously receives a flow of sorbent particles discharged via solids inlet 44 and batchwise discharges sorbent particles via solids outlet 48. The batches of sorbent particles discharged from stripper solids outlet 48 are transported via gravity flow through conduit 50. As used herein, the term "gravity flow" denotes the movement of solids through a conduit, wherein the movement is caused primarily by gravitational force.

Reactor lockhopper 34 is operable to transition the sorbent particles from the high pressure hydrocarbon environment of reactor 12 and reactor stripper 32 to the low pressure oxidizing (oxygen) environment of regenerator 14. To accomplish this transition, reactor lockhopper 34 periodically receives batches of sorbent particles from reactor stripper 32, isolates sorbent particles from reactor stripper 32 and regenerator feed surge vessel 36, and changes the pressure and composition of the environment surrounding the sorbent particles from a high pressure hydrocarbon environment to a low pressure inert (e.g., nitrogen and/or argon) environment. After the environment of the sorbent particles has been transitioned, as described above, sorbent particles are batchwise transported from an outlet of reactor lockhopper 34 to an inlet of regenerator feed vessel 36 via gravity flow in conduit 52.

Regenerator feed vessel 36 is operable to receive batches of sorbent particles from reactor lockhopper 34 and substantially continuously discharge the sorbent particles to a lift line 54 of pneumatic lift 38. Thus, regenerator feed surge vessel 36 is operable to transition the flow of sorbent particles from a batchwise flow to a substantially continuous flow. The substantially continuous flow of sorbent particles from the regenerator feed surge vessel 36 to pneumatic lift 38 is provided via gravity flow. Pneumatic lift 38 employs a lift gas to dilute phase transport the sorbent particles upwardly to a solids inlet 56 of regenerator 14. As used herein, the term "dilute phase transport" shall denote the transport of solids by a fluid having a velocity that is at or above the saltation velocity. It is preferred for the composition of the lift gas employed in pneumatic lift 38 to be substantially the same as the composition of the regeneration stream that enters regenerator 14 via inlet 24.

In regenerator 14 the solid particles are fluidized by the regeneration stream to form a fluidized bed of the sorbent particles in the regeneration zone of the regenerator 14. As used herein, the term "fluidized bed" shall denote a system of dense phase solid particles having a fluid flowing upwardly therethrough at a velocity below the saltation velocity. As used herein, the term "fluidized bed vessel" shall denote a vessel for contacting a fluid with a fluidized bed of solid particles. The sorbent particles entering regenerator 14 via solids inlet 56 are, therefore, dense phase transported by the regeneration stream upwardly in regenerator 14 to a regenerator solids outlet 58.

As mentioned above, regenerated (i.e., oxidized) sorbent particles are transported from regenerator 14 to reducer 16 via second transport assembly 26. Second transport assembly 26 generally comprises a regenerator receiver 60 and a regenerator lockhopper 62. Regenerator receiver 60 is close-coupled to regenerator 14 via a regenerator outlet close-coupling assembly 64 which extends between a regenerator solids outlet 58 and a receiver solids inlet 66. Close-coupling assembly 64 provides for substantially continuous flow of sorbent particles from regenerator 14 to regenerator receiver 60.

In regenerator receiver 60, the downwardly gravitating sorbent particles are contacted with an upwardly flowing cooling gas, which enters regenerator receiver 60 via a cooling gas inlet 68. The contacting of the cooling gas with the sorbent particles in regenerator 60 cools the sorbent particles and strips residual sulfur dioxide and carbon dioxide from around the sorbent particles. It is preferred for the cooling gas to be a nitrogen-containing gas. Most preferably, the cooling gas comprises at least 90 mole percent nitrogen. Regenerator receiver 60 includes a fluid outlet 70, through which the cooling gas exits regenerator receiver 60 and flows to a cooling gas inlet 72 of regenerator 14 via conduit 74.

The sorbent particles are batchwise transported from a solids outlet 76 of regenerator receiver 60 to an inlet of regenerator lockhopper 62 via gravity flow in conduit 78. Regenerator lockhopper 62 is operable to transition the regenerated sorbent particles from the low pressure oxygen environment of regenerator 13 and regenerator receiver 60 to the high pressure hydrogen environment of reducer 16. To accomplish this transition, regenerator lockhopper 62 periodically receives batches of regenerated sorbent particles from regenerator receiver 60, isolates regenerated sorbent particles from regenerator receiver 60 and reducer 16, and changes the pressure and composition of the environment surrounding the sorbent particles from a low pressure oxygen environment to a high pressure hydrogen environment. After the environment of the regenerated sorbent particles has been transitioned, as described above, the regenerated sorbent particles are batchwise transported from regenerated lockhopper 62 to a solids inlet 80 of reducer 16 via gravity flow in conduit 82.

In reducer 16, the batches of sorbent particles from solids inlet 80 are contacted with and fluidized by the reducing stream entering reducer 16 via a reducing stream inlet 28. The sorbent particles in reducer 16 are dense phase transported in the form of a fluidized bed from reducer solids inlet 80 upwardly to a reducer solids outlet 82. Reactor 12 is close-coupled to reducer 16 via close-coupling assembly 30 which extends between reducer solids outlet 82 and a reactor solids inlet 84. Close-coupling assembly 30 provides for dense phase transporting of the sorbent particles in a substantially batchwise fashion. As batches of solid sorbent particles enter reducer solids inlet 80, corresponding (in time) batches of sorbent particles "spillover" into reactor 12 via close-coupling assembly 30. In reactor 12 the reduced sorbent particles are contacted with the hydrocarbon-containing fluid feed entering reactor 12 via inlet 18 to thereby form a fluidized bed of sorbent particles in reactor 12. The sorbent particles in reactor 12 are dense phase transported by the hydrocarbon-containing feed upwardly to reactor solids outlet 42.

One unique feature of desulfurization unit 10 that is not found in prior art devices is the manner in which certain vessels are close-coupled to one another. In particular, the close-coupling of reactor stripper 32 to reactor 12, regenerator receiver 60 to regenerator 14, and reducer 16 to reactor 30 provide significant economic and operational advantages. The term "close-coupled" was defined above as a manner of fluidly coupling two vessels to one another wherein an open passageway is created from a solids outlet of one vessel to a solids inlet of another vessel, thereby providing for lateral dense phase transport of solids from the solids outlet to the solids inlet. Close-coupling assemblies 40, 64, and 30 (FIG. 1) each have certain unique features that will be described in detail below with reference to FIGS. 2-12; however, each of these close-coupling assemblies 40, 64, and 30 (FIG. 1) have several features in common. For example, each close-coupling assembly 40, 64, and 30 provides an open passageway between a solids outlet of one vessel and a solids inlet of another vessel in a manner such that the spacing between the solids inlet and solids outlet of the vessels is less than about 10 feet, preferably less than 5 feet. Further, each close-coupling assembly 40, 64, and 84 defines a relatively large and substantially straight open passageway through which solids can be transported from the solids outlet of one vessel to the solids inlet of another vessel while the pressure differential between the two close-coupled vessels is minimal or none. Preferably, the pressure differential between the vessels close-coupled to one another by close-coupling assemblies 40, 64, and 30 is less than about 10 psi, more preferably less than about 5 psi, and most preferably less than 1 psi for ease of operation and transfer. The open passageways defined by close-coupling assemblies 40, 64, and 30 present a minimum flow path area of at least about 10 square inches, more preferably at least 15 square inches for ease of transfer. As used herein, the term "flow path area" shall denote the cross sectional area of an opening or passageway measured perpendicular to the direction of flow through the opening. Thus, the minimum flow path area of the open passageways defined by close-coupling assemblies 40, 64, and 30 is the minimum cross sectional area of the passageway measured perpendicular of the direction of particle flow through close-coupling assemblies 40, 64, and 30. The specific configurations of close-coupling assemblies 40, 64, and 30 are described in greater detail below with reference to FIGS. 2-12.

Figure 2:
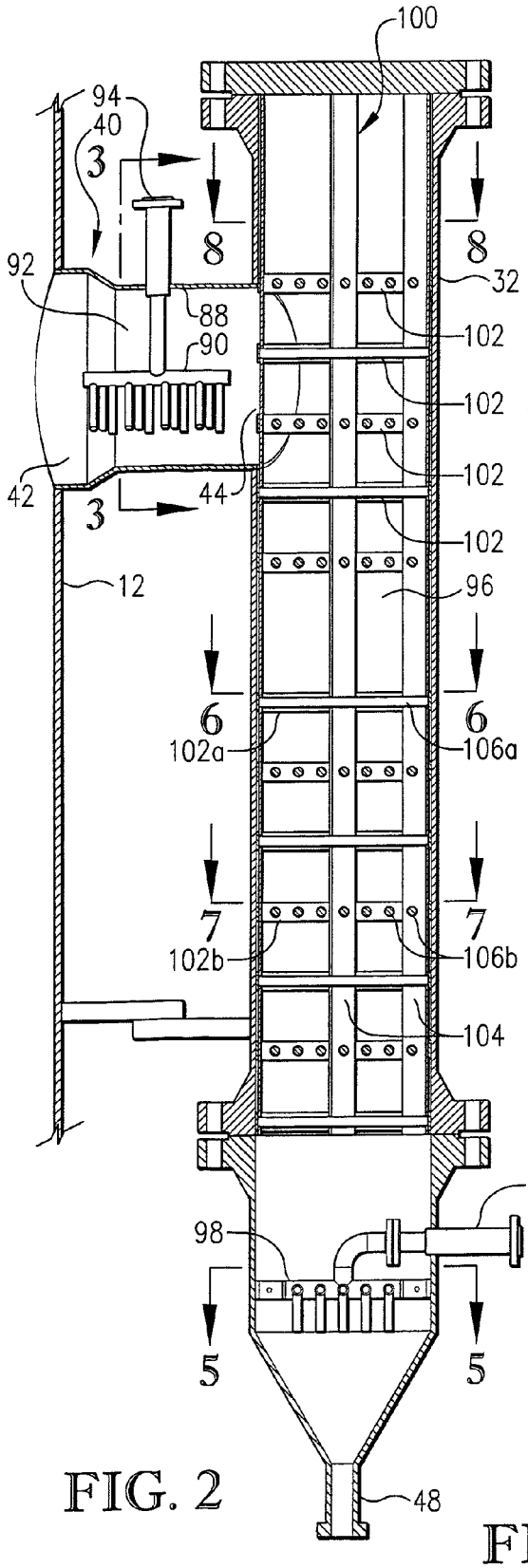
FIG. 2 is an enlarged sectional view of the reactor stripper shown in FIG. 1, particularly illustrating the manner in which the reactor stripper is coupled to the reactor via a reactor outlet close-coupling assembly which transports solid particles from the reactor to the reactor stripper.
Figure 3:
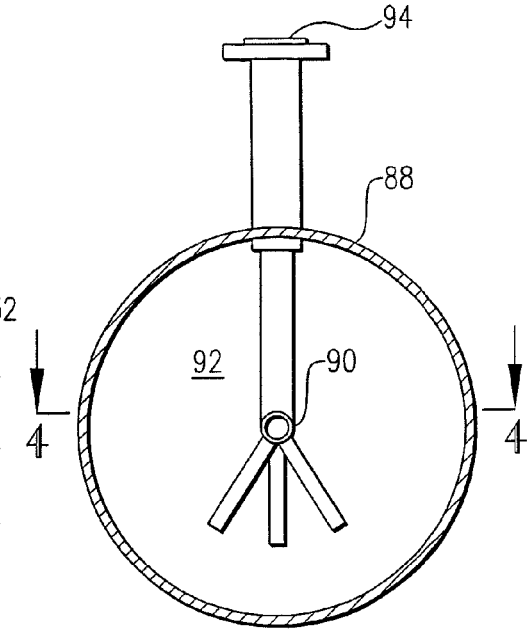
FIG. 3 is a sectional side view of the close-coupling assembly taken along line 3-3 in FIG. 2, particularly illustrating the sparger located in the open passageway defined by the close-coupling assembly.
Figure 4:
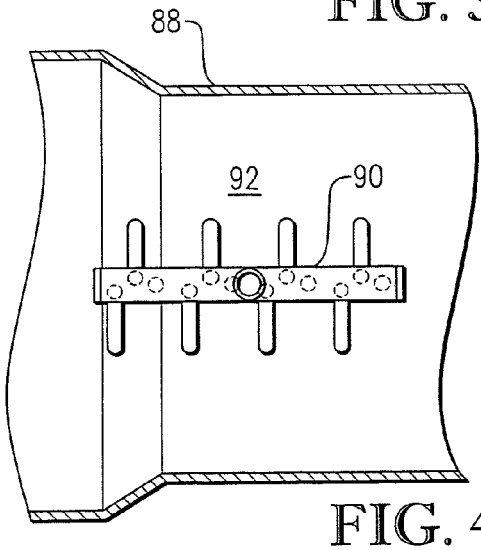
FIG. 4 is a partial sectional top view of the close-coupling assembly taken along line 4-4 in FIG. 3, further illustrating the sparger of the close-coupling assembly.

Referring to FIG. 2, reactor outlet close-coupling assembly 40 is illustrated as generally comprising a close-coupling conduit 88 and a sparger 90. Close-coupling conduit 88 defines a substantially straight, substantially horizontal open passageway 92 which extends between reactor solids outlet 42 of reactor 12 and stripper solids inlet 44 of reactor stripper 32. As shown in FIGS. 2-4, sparger 90 is disposed in open passageway 92, receives a sparging gas via sparger inlet 94, and discharges the sparging gas downwardly in close-coupling conduit 88.

Figure 5:
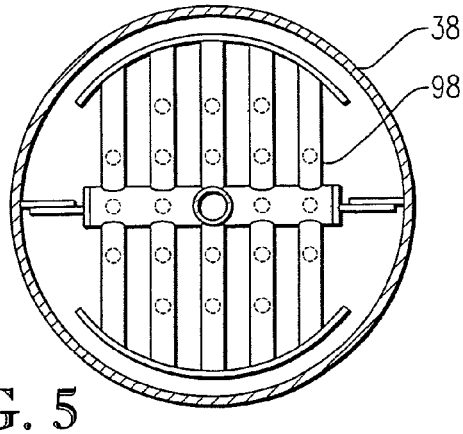
FIG. 5 is a sectional top view of the reactor stripper taken along line 5-5 in FIG. 2, particularly illustrating the configuration of the sparger located in the lower portion of the reactor stripper.
Figure 6:
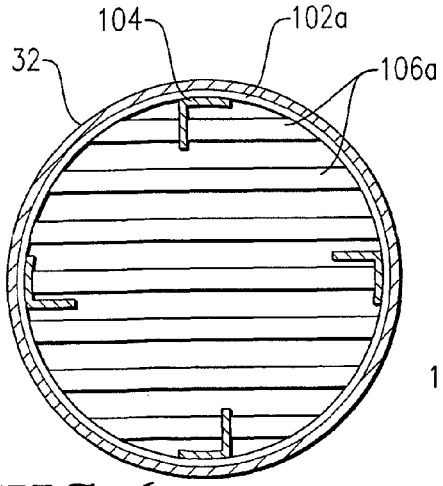
FIG. 6 is a top sectional view of the reactor stripper taken along line 6-6 in FIG. 2, particularly illustrating a first baffle group located in the stripping zone of the reactor stripper.
Figure 7:
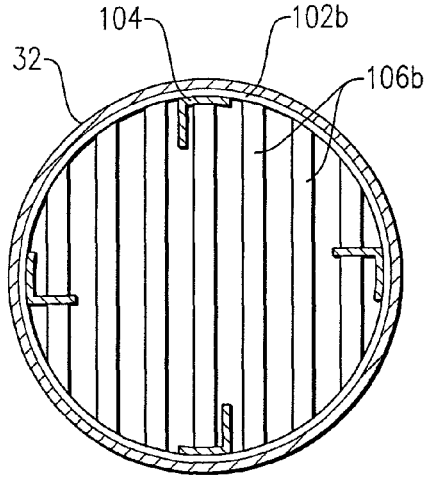
FIG. 7 is a sectional top view of the reactor stripper taken along line 7-7 in FIG. 2, particularly illustrating a second baffle group located in the stripping zone of the reactor stripper, wherein the individual baffles of the second baffle group extend substantially perpendicular to the direction of extension of the individual baffles of the first baffle group illustrated in FIG. 6.

Referring again to FIG. 2, during normal operation of the desulfurization unit, solid sorbent particles flow from the fluidized bed of reactor 12, through close-coupling conduit 88, and into a stripping zone 96 defined within reactor stripper 32. In stripping zone 96, the downwardly gravitating solid sorbent particles are contacted with an upwardly flowing stripping gas. The stripping gas enters reactor stripper 32 via stripping gas inlet 46 and is distributed in stripping zone 96 via a stripper sparger 98. During normal operation of the desulfurization unit, solid sorbent particles gravitate downwardly through stripping zone 96 towards stripper solids outlet 48. As shown in FIG. 5, reactor stripper sparger 98 is configured to allow solid sorbent particles to flow downwardly therethrough towards stripper solids outlet 48. The stripping gas employed in stripping zone 96 exits reactor stripper 32 by flowing through close-coupling conduit 88 and into reactor 12. Thus, during normal operation of the desulfurization unit, there is a simultaneous countercurrent flow in close-coupling conduit 88 of solid sorbent particles from reactor 12 to reactor stripper 32 and stripping gas from reactor stripper 32 to reactor 12. Generally, the solid sorbent particles flowing through close-coupling conduit 88 are concentrated near the bottom portion of close-coupling conduit 88, while the stripping gas flowing through close-coupling conduit 88 is concentrated in the upper portion of close-coupling conduit 88. Sparger 90 (FIGS. 2-4) is operable to prevent the solid sorbent particles from accumulating at the bottom of close-coupling conduit 88 via downward jets of the sparging gas. The sparging gas used to maintain fluidization of the solid sorbent particles in close-coupling conduit 88 preferably has substantially the same composition as the stripping gas entering reactor stripper 32 via stripping gas inlet 46.

Figure 8:
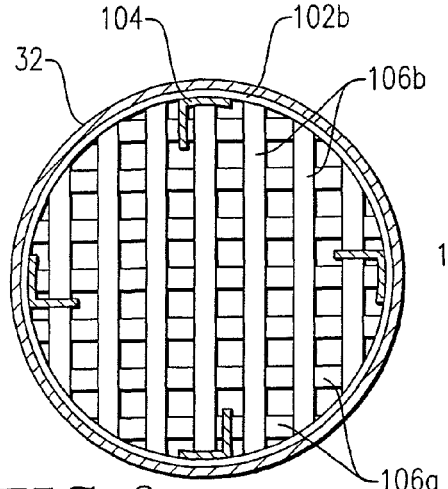
FIG. 8 is a sectional top view of the reactor stripper similar to FIGS. 6 and 7, particularly illustrating the cross-hatched pattern created by adjacent vertically spaced baffle groups of the reactor stripper.

Referring again to FIG. 2, it is preferred for a baffle assembly 100 to be employed in stripping zone 96 of reactor stripper 32 to thereby reduce axial dispersion and backmixing of the solid sorbent particles in stripping zone 96. Baffle assembly 100 generally comprises a plurality of substantially horizontal baffle groups 102 which are vertically spaced from one another and supported relative to one another by vertical supports 104. Referring to FIGS. 2 and 6-8, each baffle group 102 includes a plurality of laterally spaced individual baffles 106 which extend generally parallel to one another. It is preferred for each individual baffle 106 to present a substantially cylindrical outer surface. It is further preferred for the individual baffles 106 of adjacent vertically spaced baffle groups 102 to extend substantially perpendicular to one another. FIG. 8 illustrates the cross-hatched pattern formed by individual baffles 106 of two adjacent baffle groups 102. The configuration of baffle assembly 100 provides for optimum contacting of the stripping gas with the solid sorbent particles in stripping zone 96.

Figure 9:
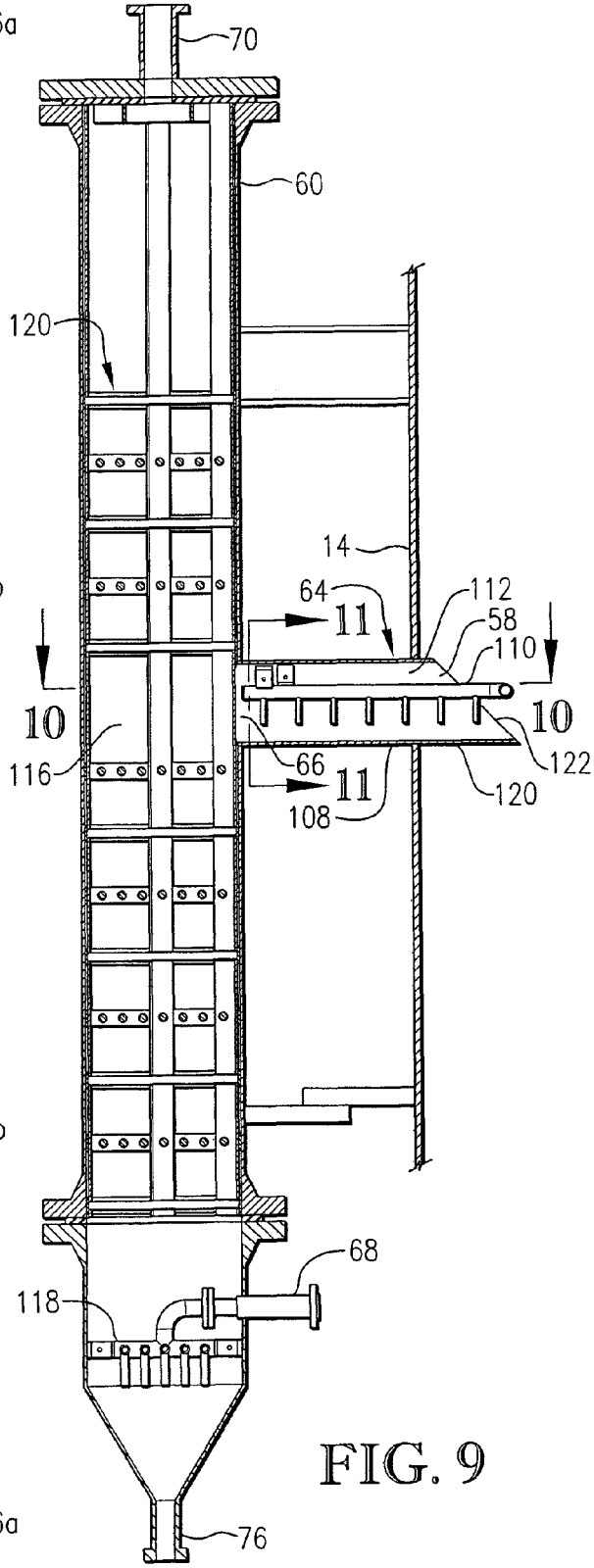
FIG. 9 is an enlarged sectional side view of the regenerator receiver shown in FIG. 1, particularly illustrating the manner in which the regenerator receiver is fluidly coupled to the regenerator via a regenerator outlet close-coupling assembly which transports solid particles from the regenerator to the regenerator receiver.
Figures 10, 11:
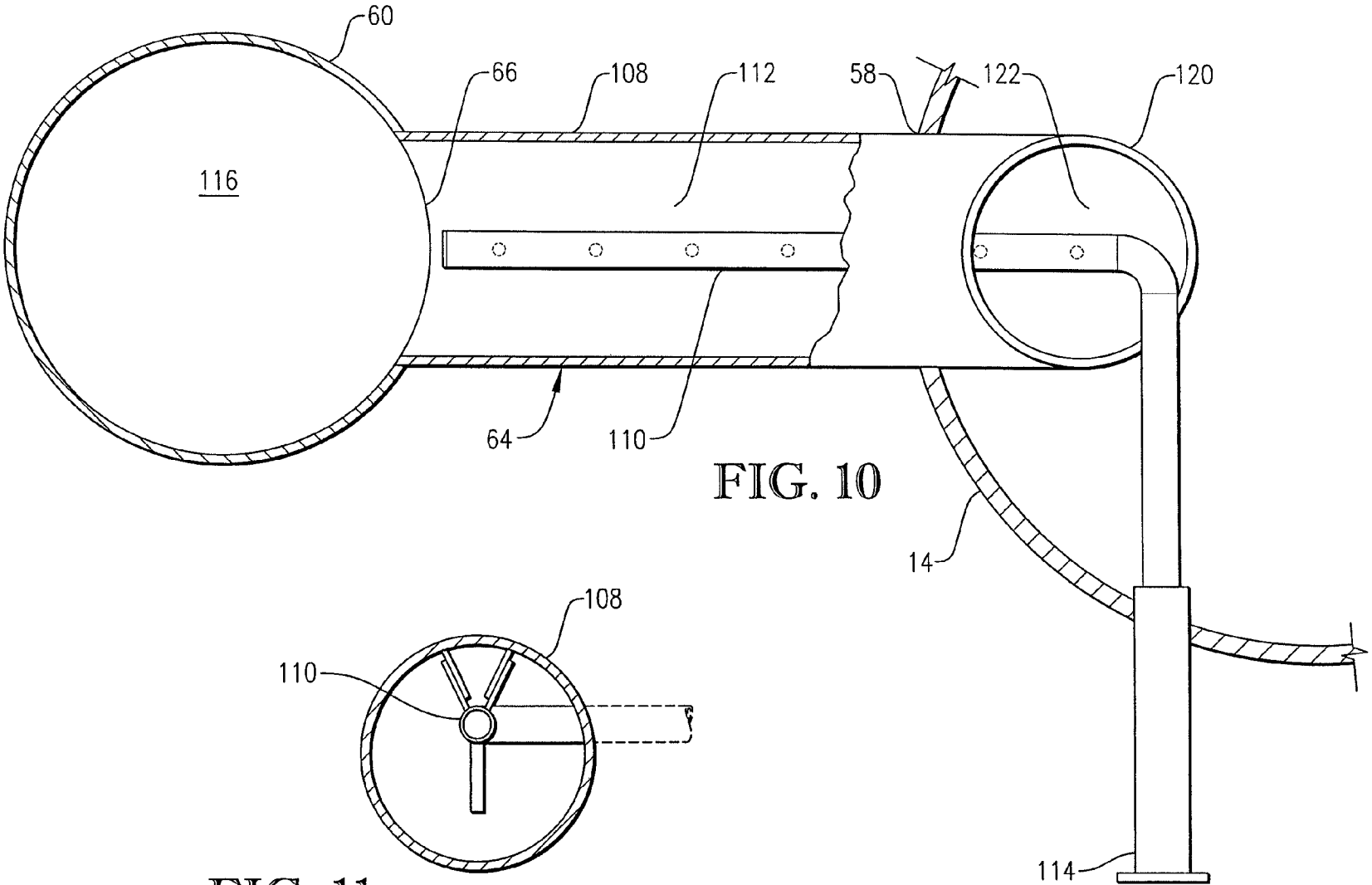
FIG. 10 is an enlarged partial sectional top view of the close-coupling assembly taken along line 10-10 in FIG. 9, particularly illustrating the sparger of the close-coupling assembly.
FIG. 11 is a sectional side view of the close-coupling assembly take along line 11-11 in FIG. 9, further illustrating the configuration of the sparger of the close-coupling assembly.

Referring to FIG. 9, a regenerator outlet close-coupling assembly 64 is illustrated as generally comprising a close-coupling conduit 108 and a sparger 110. Close-coupling conduit 108 defines a substantially straight, substantially horizontal open passageway 112 which extends between regenerator solids outlet 58 and regenerator receiver solids inlet 66. As shown in FIGS. 9-11, sparger 110 is disposed in open passageway 112, receives a sparging gas via a sparger inlet 114 (shown in FIG. 11), and discharges the sparging gas downwardly in close-coupling conduit 108.

Referring again in FIG. 9, during normal operation of the desulfurization unit, solid sorbent particles flow from the fluidized bed of regenerator 14 through close-coupling conduit 108, and into a cooling zone 116 defined within regenerator receiver 60. In cooling zone 116, the downwardly gravitating solid sorbent particles are contacted with an upwardly flowing cooling gas. The cooling gas enters regenerator receiver 60 via cooling gas inlet 68 and is distributed in cooling zone 16 via a receiver sparger 118. The cooling gas which enters cooling zone 116 via cooling gas inlet 68 preferably has a temperature that is at least about 10° F. cooler than the temperature in the regeneration zone of regenerator 14. As the cooling gas flows upwardly through the downwardly gravitating solid sorbent particles in cooling zone 116, solid sorbent particles are cooled and residual sulfur dioxide and carbon dioxide are stripped from around the solid sorbent particles. The cooling gas exits cooling zone 116 via fluids outlet 70. It is preferred for a baffle assembly 120 to be disposed in cooling zone 116 to reduce backmixing and axial dispersion of the solid sorbent particles. The configuration of baffle assembly 120 is preferably similar to the configuration of baffle assembly 100 described above with reference to FIGS. 2 and 6-8.

Referring to FIGS. 9-11, during normal operation of the desulfurization unit, regenerated solid sorbent particles are transported from the regeneration zone of regenerator 14 to cooling zone 116 of regenerator receiver 60 via close-coupling conduit 108. In order to prevent sorbent particles from accumulating at the bottom of close-coupling conduit, sparger 110 directs a downward jet of sparging gas towards the bottom of close-coupling conduit 108, to thereby maintain the transported sorbent particles in a fluidized state. It is preferred for close-coupling conduit to include an insert section 120 which extends through the vessel wall of regenerator 14 and into the regeneration zone of regenerator 14. Preferably, insert section 120 extends at least about 6 inches into the regeneration zone of regenerator 14, more preferably about 10 to about 20 inches into the regeneration zone. Insert 120 defines a skewed opening 122 which faces generally upward from vertical. Preferably, skewed opening 122 faces upwardly at an angle of at least about 15° relative to vertical, more preferably about 30° to about 60° relative to vertical. Insert section 120 is operable to improve the transport of the regenerated sorbent particles through close-coupling conduit 108 by reducing circular flow paths of the sorbent particles through close-coupling conduit 108 which can be exhibited when insert section 120 is not employed.

Figure 12:
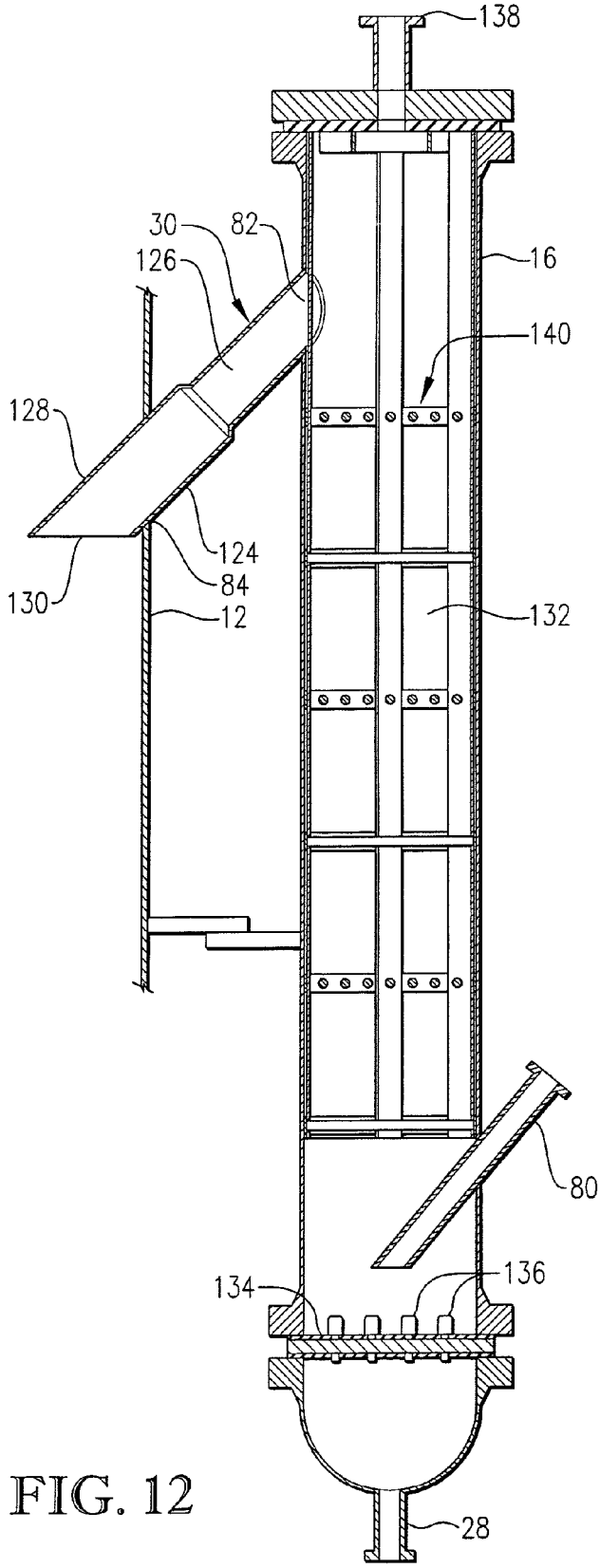
FIG. 12 is an enlarged sectional side view of the reducer shown in FIG. 1, particularly illustrating the manner in which the reducer is fluidly coupled to the reactor via a reducer outlet close-coupling assembly which transports solid particles form the reducer to the reactor.

Referring to FIG. 12, a reducer outlet close-coupling assembly 30 is illustrated as generally comprising a close-coupling conduit 124. Close-coupling conduit 124 defines a substantial straight open passageway 126 which extends downwardly between reducer solids outlet 82 and reactor solids inlet 84. It is preferred for open passageway 126 to extend at a downward angle in the range of from about 15° to about 75° relative to horizontal, more preferably in the range of from about 30° to about 60° from horizontal. It is preferred for close-coupling conduit 124 to include an insert section 128 which extends through the vessel wall of reactor 12 and into the desulfurization zone. Preferably, insert section 128 extends at least about 6 inches into the desulfurization zone, more preferably about 8 to about 20 inches into the desulfurization zone. It is preferred for insert 128 to define a generally downwardly facing opening 130. The configuration of insert section 128 and downwardly facing opening 130 prevent stagnate sorbent particles from accumulating at reactor solids inlet 84.

Reducer 16 receives batches of sorbent particles via reducer solids inlet 80. In a reducing 132 zone of reducer 16 the solid sorbent particles are fluidized by a reducing stream entering reducer 16 via reducing stream inlet 28. Reducer 16 includes a distribution plate 134 which defines the bottom of reducing zone 132 and prevents solid sorbent particles from exiting reducer 16 via reducing stream inlet 28. Distribution plate 134 can include a plurality of bubble caps 136 which allow the reducing stream to flow upwardly through distribution plate 134 and into reducing zone 132. The reducing stream can exit reducer 116 via fluids outlet 138. A baffle assembly 140 (similar to baffle assembly 100 described above with reference to FIGS. 2 and 6-8) may be disposed in reducing zone 132 to minimize axial dispersion and backmixing of sorbent particles in reducing zone 132. In operation, as batches of sorbent particles are received in reducing zone 132 via reducer solids inlet 80, batches of the reduced sorbent particles near the top of reducer 116 "spillover" into close-coupling conduit 124 via reducer solids outlet 82 and flow downwardly through open passageway 126 via gravity flow into the desulfurization zone of reactor 12.

Referring again to FIG. 1, the layout of desulfurization unit 10 provides a number of advantages over conventional desulfurization units which continuously circulate fluidizable sorbent particles between a reactor, regenerator, and reducer. The relative elevations of the individual vessels employed in desulfurization unit 10 provide for dense phase gravity flow between a number of the vessels. For example, dense phase gravity flow is provided between reactor stripper 32 and reactor lockhopper 34 via conduit 50, reactor lockhopper 34 and regenerator feed surge vessel 36 via conduit 52, regenerator receiver 60 and regenerator lockhopper 62 via conduit 78, and regenerator lockhopper 62 and reducer 16 via conduit 82. Such dense phase gravity flow transport of the solid sorbent particles reduces attrition of the particles and also reduces the need for other more expensive equipment (e.g., pneumatic conveyors) to transport particles. A further advantage of the layout of desulfurization unit 10 is that the only location where dilute phase transport of the solid particles is required is in lift line 54. Other than the dilute phase transport in lift line 54, all other transport within and between the vessels of desulfurization unit 10 is accomplished in dense phase, thereby reducing attrition of the solid particles. Still another advantage of the layout of desulfurization unit 10 is the fact that the vertical elevation of the vessels above a horizontal base line 86 is minimized. Although it would be possible to design a desulfurization unit using entirely gravity flow between vessels, such a unit would require a number of the vessels to be located at extremely high elevations which are not practical from a construction and operational standpoint. Inventive desulfurization unit 10 provides an optimal layout of vessels which minimizes high velocity transport (i.e., dilute phase transport) of the solid sorbent particles, minimizes equipment, maximizes the use of gravity flow transport of the solid sorbent particles, and minimizes the elevation of the vessels above horizontal base line 86.

Reasonable variations, modifications, and adaptations may be made within the scope of this disclosure and the appended claims without departing from the scope of this invention.

What is claimed is:

1. A method of desulfurizing a hydrocarbon-containing fluid, said method comprising the steps of:

(a) contacting said hydrocarbon-containing fluid with solid particles in a desulfurization zone under desulfurization conditions sufficient to remove sulfur from said hydrocarbon-containing fluid and provide sulfur-loaded solid particles;

(b) dense phase transporting said sulfur-loaded solid particles from said desulfurization zone to a regenerator feed surge vessel;

(c) dilute phase transporting said sulfur-loaded solid particles from said regenerator feed surge vessel to a regeneration zone;

(d) contacting said sulfur-loaded solid particles with an oxygen-containing regeneration stream in said regeneration zone under regeneration conditions sufficient to remove sulfur from said sulfur-loaded solid particles, thereby providing oxidized solid particles;

(e) contacting said oxidized solid particles with a hydrogen-containing reducing stream in a reducing zone under reducing conditions sufficient to reduce said oxidized solid particles, thereby providing reduced solid particles; and (f) dense phase transporting said reduced solid particles from said reducing zone to said desulfurization zone.

2. The method of claim 1, further comprising:

(g) dense phase transporting said oxidized solid particles from said regeneration zone to said reducing zone.

3. The method of claim 1, further comprising:

(h) contacting said sulfur-loaded solid particles with a stripping fluid in a stripping zone under stripping conditions sufficient to remove said hydrocarbon-containing fluid from around said sulfur-loaded solid particles.

4. The method of claim 3, wherein step (b) includes dense phase transporting said sulfur-loaded solid particles from said desulfurization zone to said stripping zone through an open passageway.

5. The method of claim 4, further comprising:

(i) simultaneously with step (b), causing said stripping fluid to flow from said stripping zone to said desulfurization zone through an open passageway.

6. The method of claim 4, wherein during step (b), the pressure in said stripping zone is maintained within about 10 psi of the pressure in said desulfurization zone.

7. The method of claim 3, wherein step (b) includes batchwise transporting said sulfur-loaded solid particles from said stripping zone to a reactor lockhopper, wherein step (b) includes batchwise transporting said sulfur-loaded solid particles from said reactor lockhopper to said regenerator feed surge vessel; wherein step (c) includes substantially continuously transporting said sulfur-loaded solid particles from said regenerator feed surge vessel to said regenerator.

8. The method of claim 7, wherein said sulfur-loaded solid particles are transported from said stripping zone to said reactor lockhopper and from said reactor lockhopper to said regenerator feed surge vessel via gravity flow.

9. The method of claim 1, further comprising:

(j) contacting said oxidized solid particles with a cooling fluid in a cooling zone under cooling conditions sufficient to cool said oxidized solid particles.

10. The method of claim 9, wherein step (j) includes removing sulfur dioxide from around said oxidized solid particles.

11. The method of claim 9, further comprising:

(k) simultaneously with steps (d) and (j), dense phase transporting oxidized solid particles from said regeneration zone to said cooling zone through a first open passageway.

12. The method of claim 11, further comprising:

(l) simultaneously with step (k), causing said cooling fluid to flow from said cooling zone to said regeneration zone through a second open passageway, wherein said first and second open passageways are spaced from one another.

13. The method of claim 11, wherein during step (k) the pressure in said cooling zone is maintained within about 10 psi of the pressure in said regeneration zone.

14. The method of claim 9, further comprising:

(m) batchwise transporting said oxidized solid particles from said cooling zone to a regenerator lockhopper; and (n) batchwise transporting said oxidized solid particles from said regenerator lockhopper to said reducer.

15. The method of claim 14, wherein steps (m) and (n) are accomplished via gravity flow.

16. The method of claim 1, wherein step (a) includes contacting said hydrocarbon-containing fluid with a fluidized bed of said solid particles, wherein step (d) includes contacting said oxygen-containing regeneration stream with a fluidized bed of said sulfur-loaded solid particles, wherein step (e) includes contacting said hydrogen-containing reducing stream with a fluidized bed of said oxidized solid particles.

17. The method of claim 1, wherein said desulfurization conditions, said regeneration conditions, and said reducing conditions each include a superficial velocity of less than about 10 feet per second.

18. The method of claim 1, wherein steps (a) through (d) are carried out simultaneously.

19. The method of claim 1, wherein during step (f), the pressure in said desulfurization zone is maintained within about 10 psi of the pressure in said reducing zone.

20. The method of claim 1, wherein said desulfurization conditions include a weighted hourly space velocity in the range of from about 0.1 to about 10.

21. The method of claim 1, wherein said solid particles comprise zinc oxide and a promoter metal component.

22. The method of claim 21, wherein step (a) includes converting at least a portion of said zinc oxide to zinc sulfide.

23. The method of claim 22, wherein step (d) includes converting at least a portion of said zinc sulfide to zinc oxide.

24. The method of claim 23, wherein step (d) includes oxidizing said promoter metal component.

25. The method of claim 24, wherein step (e) includes reducing said oxidized promoter metal component.

26. The method of claim 20, wherein said promoter metal component comprises a promoter metal selected from the group consisting of nickel, cobalt, iron, manganese, tungsten, silver, gold, copper, platinum, zinc, tin, ruthenium, molybdenum, antimony, vanadium, iridium, chromium, palladium, and combinations thereof.

27. The method of claim 26, wherein said promoter metal is nickel.

28. The method of claim 26, wherein said promoter metal component is a substitutional solid solution of said promoter metal and zinc.

29. The method of claim 1, wherein said solid particles have a mean particle size in the range of from about 20 to about 150 microns.

30. The method of claim 1, wherein said solid particles have a Group A Geldart classification.

31. A method of desulfurizing a hydrocarbon-containing fluid, said method comprising the steps of:

(a) contacting said hydrocarbon-containing fluid with solid particles in a fluidized bed reactor under desulfurization conditions sufficient to remove sulfur from said hydrocarbon-containing fluid and provide sulfur-loaded solid particles;

(b) contacting said sulfur-loaded solid particles with an oxygen-containing regeneration stream in a fluidized bed regenerator under conditions sufficient to remove sulfur from said sulfur-loaded solid particles, thereby providing oxidized solid particles;

(c) dense phase transporting said oxidized solid particles from said fluidized bed regenerator to a fluidized bed reducer;

(d) contacting said oxidized solid particles with a hydrogen-containing reducing stream in said fluidized bed reducer under reducing conditions sufficient to reduce said oxidized solid particles, thereby providing reduced solid particles;

(e) dense phase transporting said sulfur-loaded solid particles from said reactor to a regenerator feed surge vessel; and (f) dilute phase transporting said sulfur-loaded solid particles from said regenerator feed surge vessel to said regenerator.

32. The method of claim 31, wherein step (c) is accomplished via gravity flow.

33. The method of claim 31, wherein said reducer is close-coupled to said reactor.

34. The method of claim 31, wherein steps (a) through (d) are carried out simultaneously.

35. The method of claim 31, wherein step (e) includes dense-phase transporting said sulfur-loaded solid particles from a reactor stripper to a reactor lockhopper, wherein said reactor stripper is close-coupled to said reactor.

36. The method of claim 35, wherein step (e) is accomplished via gravity flow.

37. The method of claim 31, wherein step (c) includes dense phase transporting said oxidized solid particles from a regenerator receiver to a regenerator lockhopper, wherein said regenerator receiver is close-coupled to said regenerator.

38. A method of desulfurizing a hydrocarbon-containing fluid, said method comprising the steps of:

(a) contacting said hydrocarbon-containing fluid with solid particles in a desulfurization zone under desulfurization conditions sufficient to remove sulfur from said hydrocarbon-containing fluid and provide sulfur-loaded solid particles;

(b) contacting said sulfur-loaded solid particles with a stripping gas in a stripping zone under stripping conditions sufficient to remove said hydrocarbon-containing fluid from around said sulfur-loaded solid particles;

(c) batchwise transporting said sulfur-loaded solid particles from said stripping zone to a reactor lockhopper;

(d) batchwise transporting said sulfur-loaded solid particles from said reactor lockhopper to a regenerator surge feed vessel;

(e) substantially continuously transporting said sulfur-loaded solid particles from said regenerator feed surge vessel to a regeneration zone; and (f) contacting said sulfur-loaded solid particles with an oxygen-containing regeneration stream in said regeneration zone under regeneration conditions sufficient to remove sulfur from said sulfur-loaded solid particles, thereby providing oxidized solid particles.

39. The method of claim 38, further comprising:

(g) dense phase transporting said sulfur-loaded solid particles from said desulfurization zone to said stripping zone.

40. The method of claim 39, wherein step (e) includes dilute phase transporting said sulfur-loaded solid particles to said regeneration zone.

41. The method of claim 38, further comprising:

(h) contacting said oxidized solid particles with a hydrogen-containing reducing stream in a reducing zone under reducing conditions sufficient to reduce said oxidized solid particles, thereby providing reduced solid particles.

42. The method of claim 41, further comprising:

(i) batchwise transporting said reduced solid particles from said reducing zone to said desulfurization zone.

43. The method of claim 42, wherein step (i) is carried out while maintaining said reduced solid particles in dense phase.

44. The method of claim 41, further comprising:

(j) contacting said oxidized solid particles with a cooling gas in a cooling zone under cooling conditions sufficient to cool said oxidized solid particles.

45. The method of claim 44, further comprising:

(k) substantially continuously transporting said oxidized solid particles from said regeneration zone to said cooling zone.

46. The method of claim 45, further comprising:

(l) batchwise transporting said oxidized solid particles from said cooling zone to a regenerator lockhopper; and (m) batchwise transporting said oxidized solid particles from said regenerator lockhopper to said reducing zone.

47. The method of claim 46, wherein steps (k), (l), and (m) are carried out while maintaining said oxidized solid particles in dense phase.

* * * * *